US006274985B1

(12) United States Patent
Haynes

(10) Patent No.: US 6,274,985 B1
(45) Date of Patent: Aug. 14, 2001

(54) BINDABLE ELECTROLUMINESCENT DISPLAY

(75) Inventor: Bryan D. Haynes, Pacifica, CA (US)

(73) Assignee: Add-Vision, Inc., Pacifica, CA (US)

( * ) Notice: Subject to any disclaimer, the term of this patent is extended or adjusted under 35 U.S.C. 154(b) by 0 days.

(21) Appl. No.: 09/534,942

(22) Filed: Mar. 24, 2000

Related U.S. Application Data

(60) Provisional application No. 60/125,989, filed on Mar. 24, 1999.

(51) Int. Cl.[7] ..... G09G 3/10

(52) U.S. Cl. ..... 315/169.3; 313/505; 345/45

(58) Field of Search ..... 315/169.3; 313/506, 313/509, 510, 512, 505; 345/45, 76, 160, 169, 156, 173

(56) References Cited

U.S. PATENT DOCUMENTS

| | | | | |
|---|---|---|---|---|
| 4,683,360 | * | 7/1987 | Maser | 200/314 |
| 5,243,332 | * | 9/1993 | Jacobson | 345/76 |
| 5,301,982 | * | 4/1994 | Brotz | 283/83 |
| 5,483,120 | * | 1/1996 | Murakami | 315/169.3 |
| 5,597,183 | * | 1/1997 | Johnson | 283/83 |
| 5,634,080 | * | 5/1997 | Kikinis et al. | 345/156 |
| 6,011,607 | * | 1/2000 | Yamazaki et al. | 349/153 |
| 6,054,809 | * | 4/2000 | Haynes et al. | 313/505 |

* cited by examiner

*Primary Examiner*—Don Wong
*Assistant Examiner*—Thuy Vinh Tran
(74) *Attorney, Agent, or Firm*—Pillsbury Winthrop LLP

(57) ABSTRACT

An electroluminescent display which can be bound into a publication which comprises multiple sheets. In one embodiment is an electroluminescent display comprising a rear substrate, a front substrate, an electroluminescent lamp assembly positioned between the rear substrate and the front substrate, a margin portion which defines at least one edge of the display and has a width necessary for permitting the display to be bound in a publication, a power source positioned between the rear substrate and the front substrate and one or more conductive traces which are disposed proximate to the perimeter of the rear substrate and which connect the power source with the electroluminescent lamp assembly. The electroluminescent lamp can comprise more than one independently addressable picture elements and the display can also include a controller for the electroluminescent lamp assembly.

17 Claims, 2 Drawing Sheets

BINDABLE ELECTROLUMINESCENT DISPLAY

This application claims the benefit of U.S. application Ser. No. 60/125,989, filed Mar. 24, 1999, which application is incorporated herein by reference.

FIELD OF THE INVENTION

The present invention relates to electroluminescent displays. More specifically, the present invention relates to a bindable electroluminescent display for use in advertising and similar industries.

BACKGROUND OF THE INVENTION

The advertising and publishing industries constantly demand fresh ideas and new presentation styles to maintain the interest of potential customers. One way to provide freshness in presentation is to use lighting or animation in the promotion. Previously, advertisers looking for dramatic lighting effects or motion in their advertisements necessarily turned to television or billboards. With the onslaught of web based advertisement, promotional material can be more eye-catching and interactive than ever. Magazines and other printed publications are at a disadvantage in this game, primarily because they are limited to still pictures. Promotions in printed publications cannot at this point, grab the readers attention in the same way that promotions in other material can. Printed publications have previously enhanced their advertising through the inclusion of samples, scent and special effects such as holographic images. However, there remains a need for a printed page which can be included in a bound publication or similar material and has the capability to display motion and lighting effects to catch the eye and the interest of the viewer.

SUMMARY OF THE INVENTION

The current invention is a bindable electroluminescent display which is suitable for inclusion in publications such as magazines or newspapers. The invention, in a preferred form, includes a substrate with a margin portion. An electroluminescent lamp assembly is attached with or printed on the substrate. The electroluminescent lamp assembly is controlled by a microprocessor or other controller. The microprocessor and electroluminescent lamp are powered by a flat battery which is connected with the microprocessor and electroluminescent lamp assembly by one or more printed conductive conductive perimeter traces.

BRIEF DESCRIPTION OF THE DRAWINGS

The present invention will be better understood by reference to the appended figures and the following detailed description.

DETAILED DESCRIPTION OF THE INVENTION

Figure 1:
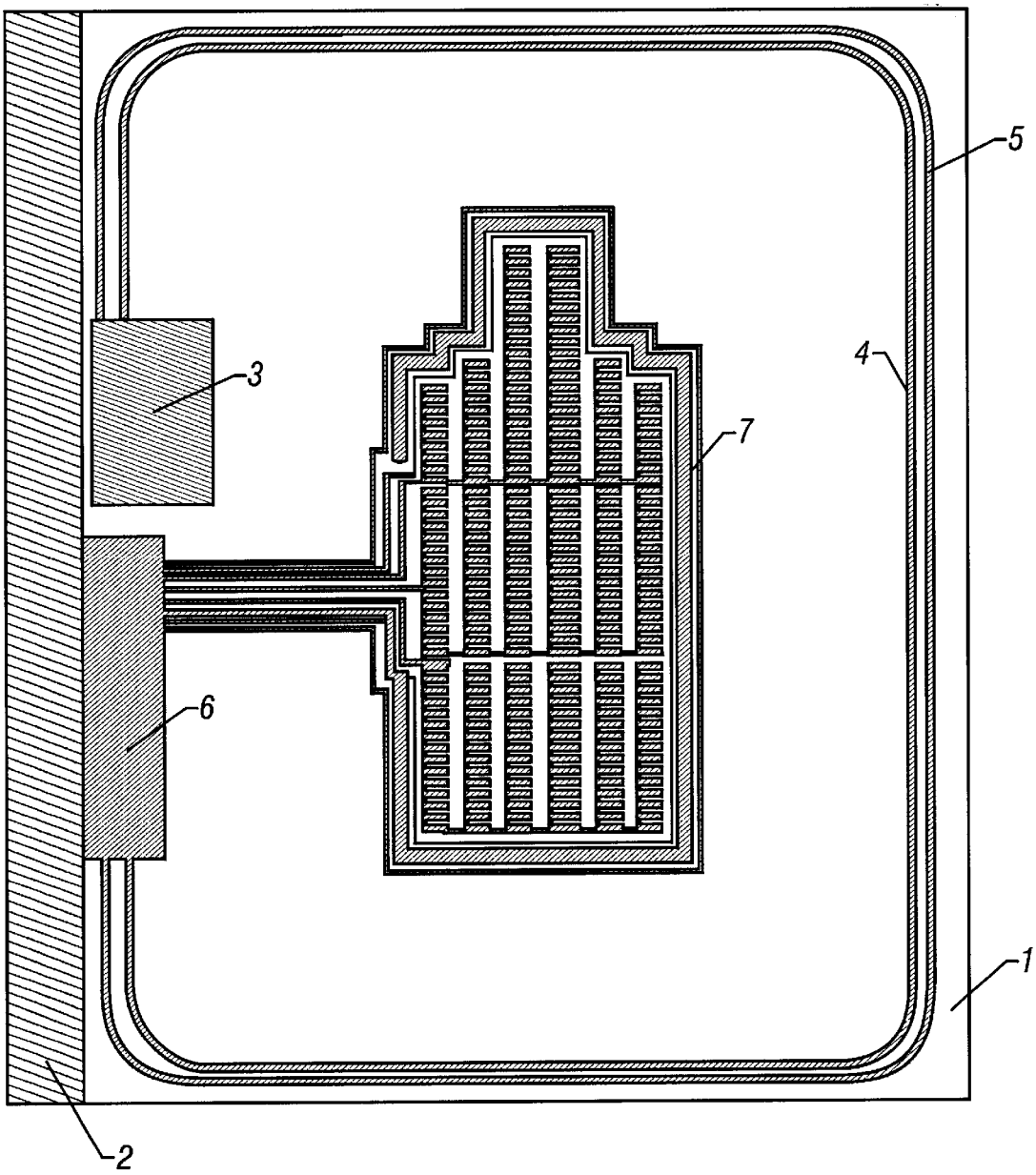
FIG. 1 is cross sectional top view of an embodiment of the bindable electroluminescent display.
Figure 2:
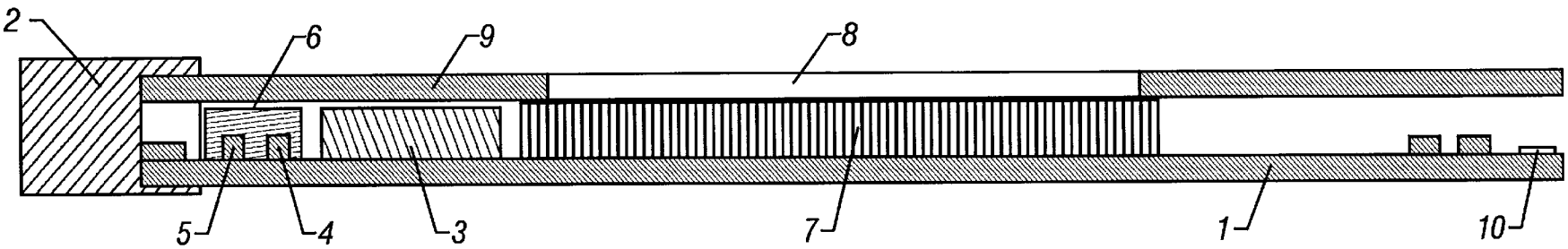
FIG. 2 is a cross-sectional side view of an embodiment of the bindable page display.

The invention, in a preferred form, and by way of example, is shown in FIGS. 1 and 2.

In FIGS. 1 and 2 the electroluminescent display includes rear substrate 1 and margin portion 2. Rear substrate 1 would most commonly be composed of paper, card or a polymer although a number of other options are available. A suitable substrate would necessarily be able to be printed upon and would need to be a material which can be bound into a publication. Margin portion 2 is compatible with and of appropriate width and thickness to be used in current binding methods for publications. As a result there is no need for a publication to be modified in order to include the page-sized electroluminescent display. Margin portion 2 can be an extension of rear substrate 1 or front substrate 9. Essentially margin portion 2 can comprise a section of rear substrate 1 or front substrate 9 or a suitable attached material which does not have elements of electroluminescent lamp assembly 7 or associated circuitry disposed thereon. Margin portion 2 therefore is a means for binding the display within a publication using available binding methods without interfering with the elements of electroluminescent lamp assembly 7. Margin portion 2 in one embodiment defines at least one edge of the display and has a width necessary for permitting the margin portion and therefore the display to be bound in a publication comprising multiple paper sheets.

Electroluminescent lamp assembly 7 is positioned on rear substrate 1. The electroluminescent lamp assembly 7 could be printed onto rear substrate 1. Typically the electroluminescent lamp assembly 7 will comprise a rear electrode, a phosphor layer, a dielectric layer and a transparent front electrode. Optionally the rear electrode could be transparent in order to allow a double sided display. The lamp can be composed of one or more typical planar electroluminescent lamps such as the ones described in U.S. application Ser. No. 08/910,724, entitled ELECTROLUMINESCENT LAMP DESIGNS which is commonly owned by the assignee of the subject application and is incorporated herein by reference.

One type of lamp which can be used is the laminar style lamp as described in U.S. application Ser. No. 08/910,724. Generally, these laminar style lamps include first and second electrically conductive layers and an electroluminescent material disposed between the first and second conductive layers. In the present invention the first electrically conductive layer includes a plurality of openings separated by electrically conductive elements. The laminar style lamps may optionally include a translucent or transparent electrically conductive layer in electrical contact with the first conductive layer. In the embodiment that does not include the translucent or transparent electrically conductive layer, it is preferred that at least one of the openings in the first conductive layer has a minimum edge to edge distance of less than about 0.005 inches. In preferred embodiments of the invention, the first conductive layer includes rectangular or hexagonal shaped openings. In another preferred embodiment, at least a portion of one of the electrically conductive elements separating the openings in the first conductive layer has a width of less than about 0.002 inches. If the lamp includes a translucent or transparent electrically conductive material layer, it is preferred that this layer is made of particles of electrically conductive material suspended in a matrix.

Another embodiment of the invention may include one or more iso-planar lamps as described in U.S. application Ser. No. 08/910,724. Such lamps include an electrically conductive layer divided into two or more electrically conductive elements by one or more channels. The lamps also include an electroluminescent material, which at least partially fills a portion of the one or more channels or at least partially covers a portion of the two or more electrically conductive elements. It is preferred that the iso-planar lamps include two conductive elements, which may be fabricated in a wide variety of shapes including inter-digitated comb-like structures, and circular and rectangular interleaved spiral structures.

Electroluminescent lamp assembly 7 may be composed of more than one independently addressable picture elements, allowing for sequencing in the illumination of electroluminescent lamp assembly 7.

Electroluminescent lamp assembly 7 is controlled by electroluminescent lamp controller 6. Controller 6 could comprise a microprocessor or a logic switching circuit. The microprocessor, logic switching circuit or other controller is programmed to direct the illumination of the independently addressable picture elements which make up electroluminescent lamp assembly 7. The picture elements can therefore be illuminated in a sequence which is aesthetically pleasing or useful. Controller 6 is incorporated into the bindable display as shown in FIG. 1.

Controller 6 and electroluminescent lamp assembly 7 are connected with a power source 3. In a preferred embodiment, power source 3 comprises a flat battery. The flat battery or other power source is connected with controller 6 and electroluminescent lamp assembly 7 by printed conductive traces 4 and 5. Power source 3 is incorporated into the page-sized display.

Conductive traces 4 and 5 are printed around the perimeter of the back substrate. The perimeter of rear substrate 1 has multiple sides and margin portion 2 extends from one side of rear substrate 1 In this conductive traces 4 and 5 are disposed adjacent to the sides of the perimeter which do not have the margin portion extending therefrom. As a result in one embodiment conductive traces 4 and 5 follow at least three sides of the rear substrate. Therefore if rear substrate 1 of the electroluminescent display is torn or damaged, the conductive trace will be broken. Breaking conductive traces 4 and/or 5 effectively shuts down the electrical current between power source 3, controller 6 and electroluminescent lamp assembly 7. This greatly reduces the danger of electric shock from the electroluminescent display. Optionally a single conductive trace can be used around the perimeter. The benefit of use of two parallel conductive traces around the perimeter of the substrate is that the electrical current will be swiftly shorted should the electroluminescent display become immersed in water. The immersion in water will swiftly create a bridge between the parallel traces, shorting the electric circuit. Conductive traces 4 and 5 can be printed silver or other appropriate conductive means.

Front substrate 9 (only shown in FIG. 2) is positioned over the entire assembly. Front substrate 9 can include transparent or translucent art work 8 (only shown in FIG. 2). The art work would include any graphics and lettering which are to be illuminated by electroluminescent lamp assembly 7. Transparent or translucent art work 8 is positioned over electroluminescent lamp assembly 7.

Seal 10 attaches front substrate 9 with rear substrate 1. Seal 10 can comprise a heat or adhesive envelope seal.

The entire electroluminescent display, including power source 3 and controller 6, can be incorporated into one bindable page of a publication. As a result a single page can be bound into a publication.

In one embodiment the electroluminescent display can operate in the following manner. Power source 3 typically comprises a flat battery which can be incorporated into the bindable electroluminescent display. An electric current from power source 3 is received by controller 6. The electric current flows through conductive perimeter traces 4 and 5. Controller 6 is typically a microcontroller or a logic switching circuit. The electric current and instruction from controller 6 can be received by electroluminescent assembly 7. Alternately the current and directions can be received by one or more integrated circuit electroluminescent drivers which control electroluminescent lamp assembly 7. Typically electroluminescent lamp assembly 7 comprises more than one independently addressable picture element. In this case more than one integrated circuit electroluminescent driver 11 can be used to illuminate the cells of electroluminescent lamp assembly 7.

The detailed description of the invention and the associated figures are intended to be illustrative only and do not define or limit the scope of the invention. The scope of the invention is defined by the appended claims and equivalents thereto.

What is claimed is:

1. An electroluminescent display comprising:

a rear substrate;

a front substrate;

a margin portion attached with at least one of the rear substrate or front substrate, said margin portion defining at least one edge of the display and having a width necessary for permitting said margin portion to be bound in a publication comprising multiple paper sheets;

an electroluminescent lamp assembly positioned between the rear substrate and the front substrate, the electroluminescent lamp assembly comprising a rear electrode, electroluminescent material and a transparent or translucent front electrode;

a power source positioned between the rear substrate and the front substrate;

one or more conductive traces, disposed proximate to the perimeter of the rear substrate connecting the power source with the electroluminescent lamp assembly.

2. The electroluminescent display described in claim 1 wherein the margin portion comprises an extension of one edge of the rear substrate of the display and wherein the margin portion includes no elements of the electroluminescent lamp assembly.

3. The electroluminescent display described in claim 1, wherein the perimeter of the rear substrate has multiple sides, wherein the margin portion extends from one side of the rear substrate and wherein the one or more conductive traces are disposed adjacent to the sides of the perimeter which do not have the margin portion extending therefrom.

4. The electroluminescent display described in claim 3, wherein the controller comprises a microprocessor.

5. The electroluminescent display described in claim 3, wherein the controller comprises a logic switching circuit.

6. The electroluminescent display described in claim 1, wherein the one or more conductive traces comprise two parallel conductive traces disposed adjacent to at least a portion of the perimeter of the substrate.

7. The electroluminescent display described in claim 1, further comprising a controller.

8. The electroluminescent display described in claim 1, wherein the power source comprises a flat battery.

9. The electroluminescent display described in claim 1, wherein the rear substrate is composed of paper.

10. The electroluminescent display described in claim 1, wherein the rear substrate is composed of a polymer.

11. The electroluminescent display described in claim 1, wherein the front substrate includes transparent or translucent artwork.

12. The electroluminescent display described in claim 1, wherein the rear electrode is transparent and includes transparent or translucent artwork.

13. The electroluminescent display described in claim 1, wherein the electroluminescent lamp assembly comprises more than one independently addressable picture element.

14. The electroluminescent display described in claim 13, wherein the controller is programmed to illuminate the independently addressable picture elements in a sequence.

15. A method of producing an electroluminescent display comprising:

printing an electroluminescent lamp assembly on a rear substrate, the rear substrate including a margin portion, said margin portion defining at least one edge of the display and having a width necessary for permitting said margin portion to be bound in a publication comprising multiple paper sheets;

positioning a power source on the rear substrate;

positioning a controller on the rear substrate;

printing one or more conductive traces around the perimeter of the substrate such that an electrical connection is produced between the power source, the controller and the electroluminescent assembly;

attaching a front substrate with the rear substrate, such that the front substrate overlies the electroluminescent lamp assembly, the controller and the power source;

binding the electroluminescent display into a publication.

16. An electroluminescent display comprising:

a rear substrate;

a front substrate;

an electroluminescent lamp assembly positioned between the rear substrate and the front substrate, the electroluminescent assembly comprising a rear electrode, electroluminescent material and a transparent or translucent front electrode;

means for binding the display in a publication, said means including a margin portion for permitting said binding means to be fixedly attached to and bound in a publication comprising multiple paper sheets;

means for providing power to the electroluminescent lamp, said means for providing power being positioned between the rear substrate and the front substrate;

conducting means for electrically connecting the means for providing power and the electroluminescent lamp assembly, said conducting means being disposed around the perimeter of the rear substrate.

17. The electroluminescent display of claim 16, further comprising means for controlling the electroluminescent lamp.

* * * * *